US012590514B2

(12) United States Patent
Godfrey

(10) Patent No.: US 12,590,514 B2
(45) Date of Patent: Mar. 31, 2026

(54) SYSTEM FOR HYDRAULICALLY EXPANDING A LINER HANGER

(71) Applicant: Enventure Global Technology, Inc., Houston, TX (US)

(72) Inventor: Matthew Mark Godfrey, Katy, TX (US)

(73) Assignee: Enventure Global Technology Inc., Houston, TX (US)

( * ) Notice: Subject to any disclaimer, the term of this patent is extended or adjusted under 35 U.S.C. 154(b) by 109 days.

(21) Appl. No.: 18/293,112

(22) PCT Filed: Jul. 29, 2021

(86) PCT No.: PCT/US2021/043600
§ 371 (c)(1),
(2) Date: Jan. 29, 2024

(87) PCT Pub. No.: WO2023/009118
PCT Pub. Date: Feb. 2, 2023

(65) Prior Publication Data

US 2024/0328286 A1 Oct. 3, 2024

(51) Int. Cl.
*E21B 43/10* (2006.01)

(52) U.S. Cl.
CPC ..... *E21B 43/106* (2013.01)

(58) Field of Classification Search
CPC ..... E21B 43/105; E21B 43/103; E21B 43/106
See application file for complete search history.

(56) References Cited

U.S. PATENT DOCUMENTS 3,162,245 A * 12/1964 Fast ..... E21B 43/105 166/207
3,179,168 A * 4/1965 Vincent ..... E21B 43/105 166/207
3,245,471 A * 4/1966 Howard ..... E21B 43/101 166/207

(Continued)

FOREIGN PATENT DOCUMENTS

GB 2415981 A * 1/2006 ..... E21B 43/105
WO 2018148480 A1 8/2018

OTHER PUBLICATIONS

USPTO, International Search Report in parent international application serial No. PCT/US2021/043600, mailed on Apr. 14, 2022, 3 pages.

(Continued)

*Primary Examiner* — Giovanna Wright
(74) *Attorney, Agent, or Firm* — Jonathan Pierce; Derek V. Forinash; Porter Hedges LLP

(57) ABSTRACT

A system includes a seal bushing that is locked into a pup joint, which is part of a liner assembly including an expandable liner hanger. The system also includes an expansion tool that is connected to a drill pipe. The expansion tool includes an expansion cone attached to the slick joint. The slick joint can slide within the bore of the seal bushing. A ball is dropped into the drill pipe and lands on a seat of the expansion tool to increase hydraulic pressure. The ball and the seal bushing can avoid pressurizing an entire liner connected below the pup joint. When the expansion cone moves through the liner hanger at least in part under the effect of pressure, the liner hanger is expanded and anchored to a base casing.

15 Claims, 4 Drawing Sheets

(56) References Cited

U.S. PATENT DOCUMENTS

| | | | | |
|---|---|---|---|---|
| 4,281,711 | A | 8/1981 | Braddick et al. | |
| 9,062,520 | B2 | 6/2015 | Ingraham et al. | |
| 2004/0238181 | A1* | 12/2004 | Cook | E21B 43/106 166/207 |

OTHER PUBLICATIONS

USPTO, Written Opinion in parent international application serial No. PCT/US2021/043600, mailed on Apr. 14, 2022, 4 pages.

* cited by examiner

SYSTEM FOR HYDRAULICALLY EXPANDING A LINER HANGER

BACKGROUND

The disclosure relates to systems and methods for deploying and setting a liner assembly in a well. More particularly, the disclosure relates to systems and methods for anchoring a liner hanger by expanding the liner hanger using an expansion cone that moves through the liner hanger at least in part under the effect of hydraulic pressure.

A known example of deployment and setting of a liner assembly in a wellbore utilizes a bottom-up expansion to anchor a liner hanger. In this example, the liner hanger has a dog-bone shape that includes a constricted middle section and upper and lower enlarged sections. The middle section includes a plurality of outer seals. The liner is attached to the lower enlarged section of the liner hanger. An expansion tool having an expansion cone is attached to the bottom of a drill pipe. During the deployment of the liner assembly, the expansion cone is located near the bottom of the liner hanger, in the lower enlarged section. A shoulder between the lower enlarged section and the middle section rests on the face of the expansion cone so that the expansion tool and the drill pipe carry the weight of the liner assembly. The expansion is initiated by pumping a drill-pipe wiper dart into the drill pipe. The drill-pipe wiper dart typically follows the cement column. This drill-pipe wiper dart lands and nests in a liner wiper dart near the lower end of the expansion tool. Increased pressure causes the liner wiper dart to deploy, wipe the liner, and land in the shoe of the liner. These nested darts then seal the shoe of the liner, and continued pumping into the sealed liner creates, in turn, a pressure increase in the liner. The pressure increase pushes a cup seal and/or the expansion cone upward. Bottom-up expansion is used for anchoring the liner hanger to a base casing by expanding the middle section of the liner hanger using the movement of the expansion cone through the liner hanger. When pressed against the base casing because of the expansion of the middle section, the plurality of outer seals anchor the liner hanger to the base casing and provide a seal between the liner hanger and the base casing.

In some cases, the drill-pipe wiper dart and/or the liner wiper dart may fail to seal the shoe of the liner, or expansion cannot be completed due to a leak in the liner. In these cases, the operator may have no option left to complete the expansion of the liner hanger. In addition, in cases where the expansion cone is solid, the operator may have no option left to retrieve the expansion cone from the liner hanger and pull the drill pipe and the expansion tool out of the well. This lack of option presents a high risk when deploying expandable liner hangers.

There is a continuing need in the art for systems and methods for anchoring a liner hanger to a base casing by expanding the liner hanger using an expansion cone that moves under the effect of hydraulic pressure through the liner hanger.

SUMMARY

The disclosure describes a system for setting a liner assembly in a well.

The system may comprise a seal bushing. The seal bushing may include a tubular body, a plurality of dogs biased toward a center of the tubular body, a sleeve capable of sliding in the tubular body, and internal and external seals.

The sleeve of the seal bushing may include a recess capable of receiving at least a portion of each the plurality of dogs.

The system may comprise an expansion tool. The expansion tool may include a through-bore, a seat provided in the through-bore of the expansion tool, and a lateral port connected to the through-bore of the expansion tool. The lateral port may be located in an interval between the expansion cone and the seat. The expansion tool may further include a slick joint and an expansion cone attached to the slick joint. Preferably, the expansion cone is a solid expansion cone. The slick joint may have an outer sealing surface, an undercut movable below the internal seal of the seal bushing, and a shoulder.

The slick joint may be received in the through-bore of the seal bushing. The outer sealing surface may slide within a through-bore of the seal bushing. The shoulder may be capable of pushing the sleeve of the seal bushing when the slick joint slides within the through-bore of the seal bushing.

The system may comprise a pup joint. The pup joint may be connectable to a liner. The pup joint may have a groove. The groove may be engaged by each of the plurality of dogs simultaneously.

The system may comprise an expandable liner hanger. The expandable liner hanger may have an end connected to the pup joint. The expandable liner hanger may be shaped to receive the expansion cone through the end connected to the pup joint. The expandable liner hanger may have a constricted middle section expandable with the expansion cone.

Preferably, the groove may be located along the pup joint so that, when the expansion cone is received through the end of the expandable liner hanger connected to the pup joint and the groove is engaged by each of the plurality of dogs, the internal seal of the seal bushing can be located out of an interval between the expansion cone and the lateral port.

The disclosure also describes a method for setting a liner assembly in a well.

The method may comprise the step of providing an expansion system. The expansion system may include an expansion tool and a seal bushing. The expansion tool may include a through-bore, a seat provided in the through-bore of the expansion tool, and a lateral port connected to the through-bore of the expansion tool. The lateral port may be located in an interval between the expansion cone and the seat. Preferably, the expansion cone is a solid expansion cone. The expansion tool may further include an expansion cone attached to a slick joint. The slick joint may be received in a through-bore of the seal bushing. The slick joint may have an outer sealing surface that can slide within a through-bore of the seal bushing. The slick joint may include an undercut. The seal bushing may include a tubular body, a plurality of dogs biased toward a center of the tubular body, a sleeve capable of sliding in the tubular body, an internal seal, and an external seal.

The method may comprise the step of positioning the expansion cone in an expandable liner hanger.

The method may comprise the step of sealing an interspace between the expansion cone and the liner hanger by metal-to-metal contact.

The method may comprise the step of connecting a pup joint to the liner hanger. The pup joint may have a groove.

The method may comprise the step of engaging each of the plurality of dogs in the groove.

The method may comprise the step of connecting the pup joint to a liner.

The method may comprise the step of maintaining the liner at the bottom of a well by transferring a force generated by expansion pressure applied to the seal bushing to the liner.

The method may comprise the step of expanding the expandable liner hanger in the well. The step of expanding the expandable liner hanger in the well may comprise increasing a pressure differential across the seal bushing during the expansion of the liner hanger. Optionally, the step of expanding the expandable liner hanger in the well is performed at least in part by also pulling on the expansion cone with a drill string connected to the expansion tool. The step of expanding the expandable liner hanger in the well may be performed after landing a device on the seat provided in the through-bore of the expansion tool. The step of landing the device on the seat provided in the through-bore of the expansion tool may be performed after attempting to increase pressure in the liner by pumping fluid.

The method may further comprise the step of equalizing pressure across the seal bushing by aligning the internal seal with the undercut.

The method may comprise the step of retrieving the expansion system from the well. The step of retrieving the expansion system from the well may comprise disengaging the plurality of dogs from the groove by aligning a recess provided on the sleeve of the seal bushing with the plurality of dogs. For example, the recess provided on the sleeve of the seal bushing may be aligned with the plurality of dogs by pushing the sleeve of the seal bushing with a shoulder provided on the slick joint.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
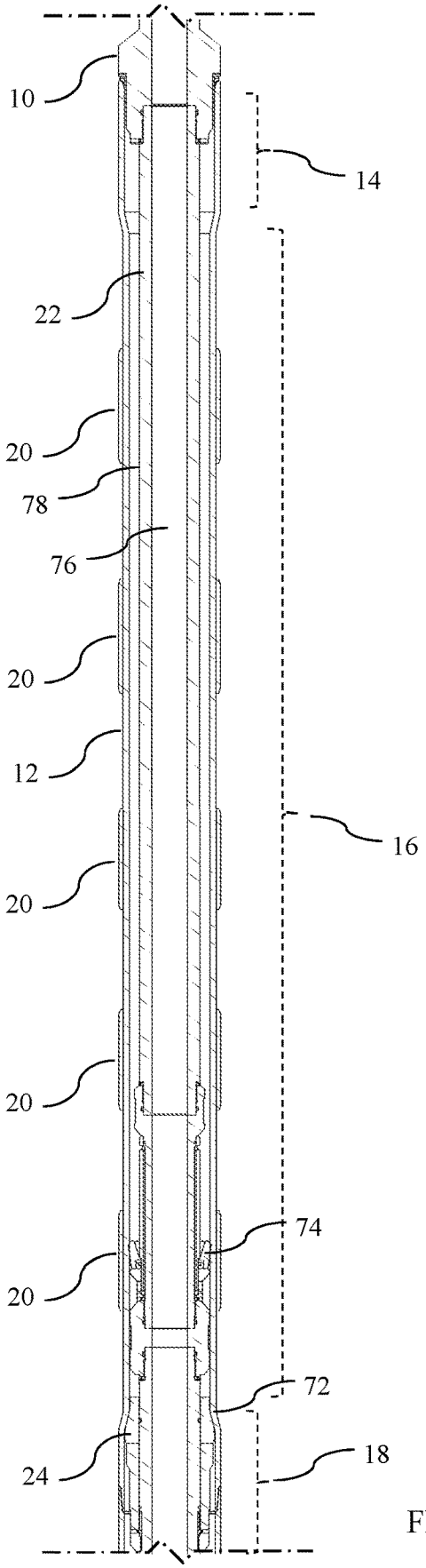
FIG. 1 is a sectional view of an upper portion of a system for setting a liner assembly in a well.

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

A liner assembly comprises an expandable liner hanger that is preferably dog-bone shaped and a liner coupled below the expandable liner hanger. The disclosure describes a system and a method for setting the liner assembly. The system and/or method can be utilized either as the sole expansion and setting mechanism of the liner assembly or as a contingency mechanism if there is a leak in the liner or if wiper darts fail to land or seal the shoe of the liner. In other words, the system and/or method can be used instead of sealing the shoe of the liner and continuing pumping into the sealed liner to increase the pressure in the entire liner. For example, the system and/or the method can be used after determining that wiper darts failed to seal the shoe of the liner, or that continued pumping into the sealed liner failed to increase the pressure in the liner.

In a preferred embodiment, the system and/or the method described herein involves a seal bushing that is locked into a pup joint provided within the liner assembly. In order to lock the seal bushing into the pump joint, a set of spring-loaded dogs are engaged in a groove provided on the inner wall of the pup joint and act to locate and lock the seal bushing in place. The seal bushing has a through-bore. Internal and external seals on the seal bushing provide pressure isolation across the seal bushing to prevent cement flow and/or hold expansion pressure. The system and/or the method described herein also involves an expansion tool that is connected at the end of a drill pipe. The expansion tool includes a solid expansion cone attached to a slick joint or equivalent machined component. The slick joint is received in the through-bore of the seal bushing. The slick joint has a long seal surface that can slide within the through-bore of the seal bushing. The expansion tool has a lateral port located between the solid expansion cone and the seal bushing.

In the preferred embodiment, a ball or other deployable device is dropped into a drill pipe and lands on a seat within the expansion tool. The seal provided by the ball avoids pressurizing the entire liner below the liner hanger in order to expand the liner hanger. Thus, pressure builds up upstream of the ball and in a volume between the seal bushing and the solid expansion cone. The pressure applied to the solid expansion cone generates an upward force that pushes the solid expansion cone upward. Upward movement of the solid expansion cone expands a constricted middle section of the liner hanger. The expansion of the middle section of the liner hanger clads the liner hanger to a base casing. Furthermore, the pressure applied to the seal bushing generates a downward force that is transmitted to the liner. The upward force is also transmitted to the liner hanger by friction between the solid expansion cone and the inner wall of the liner hanger. However, the liner assembly is usually maintained in position because of drag forces between the liner assembly and the base casing and/or between the liner assembly and the wall of the well. These drag forces, as well as the weight of the liner, can allow the operator to apply an overpull on the drill string attached to the expansion tool in combination with pressure to expand and clad the liner hanger while maintaining the liner near the bottom of the well. Once the expansion of the liner hanger is complete, an undercut in the slick joint acts to equalize pressure across the seals in the seal bushing.

In the preferred embodiment, the seal bushing can be retrieved by pulling the expansion tool up and out of the wellbore. A sliding sleeve that is provided in the seal bushing acts as a barrier between the dogs and the slick joint to prevent the dogs from damaging the seal surface. An upward pull on the sliding sleeve of the seal bushing shears a set of pins within the seal bushing, freeing the sliding sleeve. Continued upward pull strokes the sliding sleeve up such that an undercut aligns with the spring-loaded dogs. The dogs retract, freeing the seal bushing from the pup joint and allowing it to be retrieved to the surface with the expansion tool.

Figure 2:
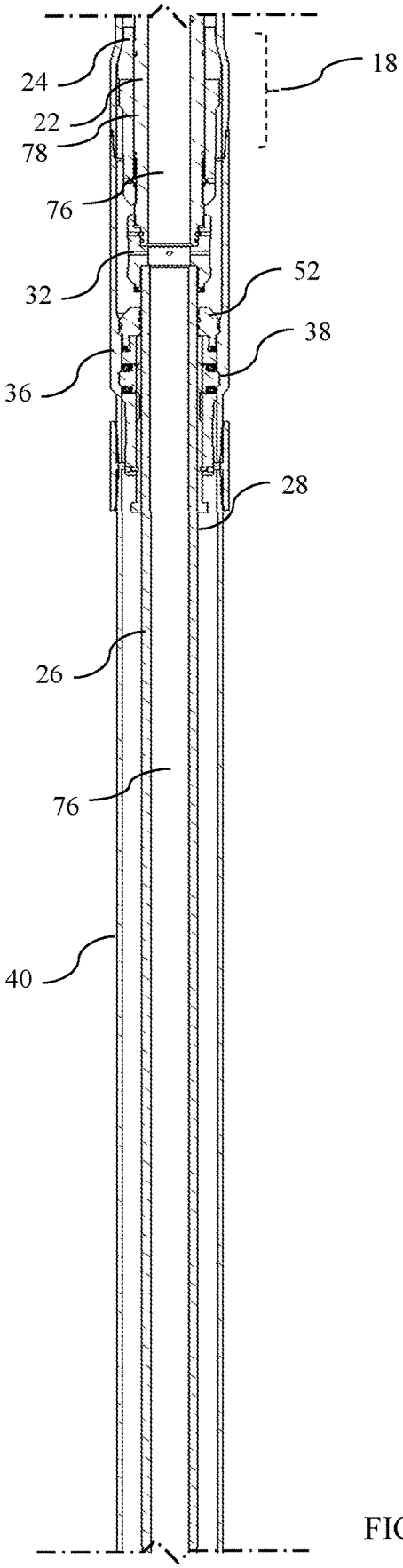
FIG. 2 is a sectional view of a middle portion of the system.
Figure 3:
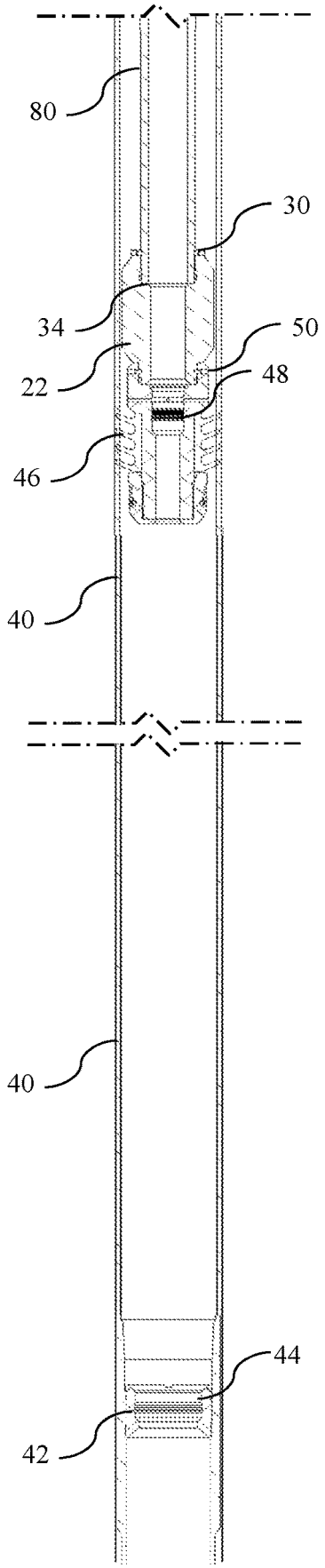
FIG. 3 is a sectional view of a lower portion of the system.
Figure 4:
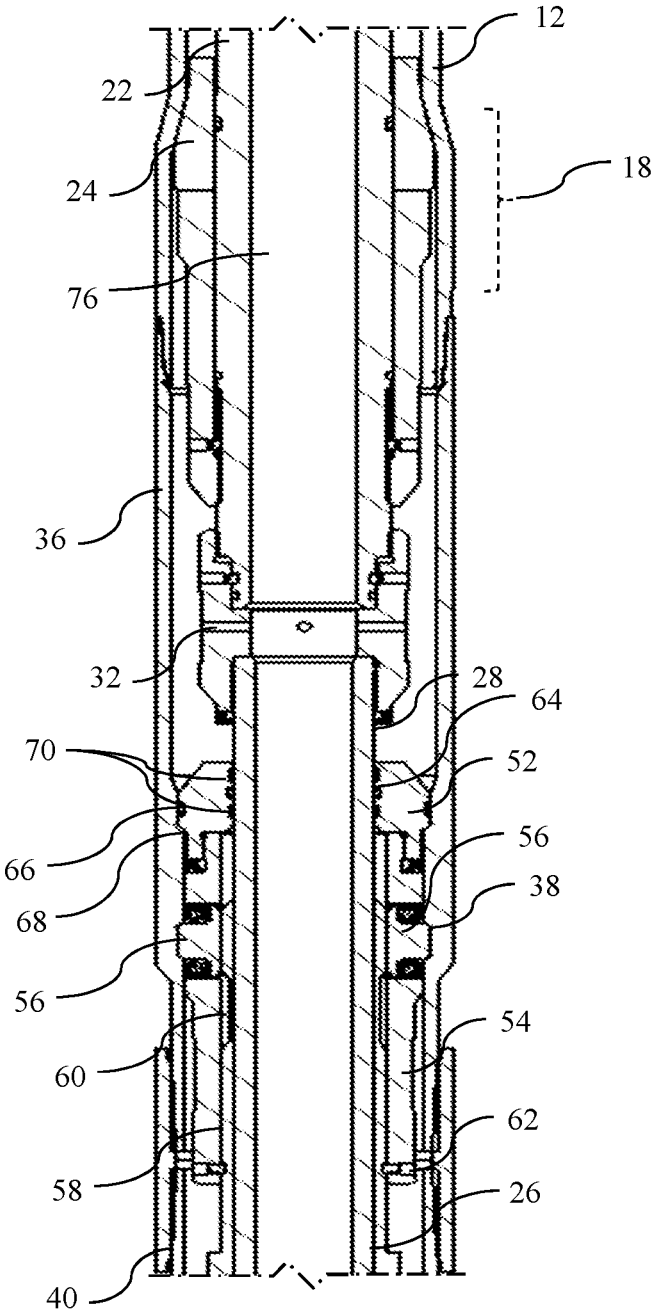
FIG. 4 is an enlarged view of the middle portion shown in FIG. 2.

FIGS. 1-3 illustrate a system for setting a liner assembly in a well in accordance with an embodiment of the invention. FIG. 4 illustrates the middle portion shown in FIG. 2 in more detail.

Referring primarily to FIG. 1, the system is attached to a drill pipe 10. The drill pipe 10 is usually suspended into a well from a derrick of a drilling rig. The drill pipe 10 is used to deploy the system into the well.

As shown, the system includes an expansion tool 22, a seal bushing 52 (FIG. 2), the expandable liner hanger 12, and a pup joint 36 (FIG. 2). In use, the pup joint 36 is integrated into a liner assembly that also includes the expandable liner hanger 12 and the liner 40 (FIGS. 2 and 3). The expandable liner hanger 12 is connected to an upper end of the pup joint 36, and the liner 40 is connected to a lower end of the pup joint 36.

As shown, the expandable liner hanger 12 includes an upper section 14, which is enlarged, a middle section 16, which is constricted, and a lower section 18, which is also enlarged. The middle section 16 includes a plurality of outer seals 20. The lower section 18 is sized such that an expansion cone 24 of the expansion tool 22 can be received through the lower end of the expandable liner hanger 12. The middle section 16 can be expanded by upward movement of the expansion cone 24. The upper section 14, which is optional, can facilitate the exit of the expansion cone 24 and the expansion tool 22 from the expandable liner hanger 12 at the end of its expansion. In use, the weight of the liner assembly is supported by resting a hanger shoulder 72 on the face of the expansion cone 24. The hanger shoulder 72 is located at a transition between the lower section 18 and the middle section 16. The system (FIGS. 1, 2, and 3) and the liner 40 are lowered in the well via the drill pipe 10, usually until a lower end of the liner 40 reaches the bottom of the well. The middle section 16 of the expandable liner hanger 12 is usually expanded in a casing already cemented in the well. The expansion of the middle section 16 of the expandable liner hanger 12 causes the plurality of outer seals 20 to clad and seal against the casing.

Referring primarily to FIG. 2, the expansion tool 22 includes a mandrel 78, a lateral port sub 32, and a slick joint 26, which are traversed by a through-bore 76. One or more lateral ports of the lateral port sub 32 are connected to the through-bore 76. The top of the mandrel 78 is connected to drill pipe 10 (FIG. 1), the bottom of the mandrel 78 is connected to the lateral port sub 32, and the top of the slick joint 26 is connected to the lateral port sub 32.

In use, the seal bushing 52 is initially connected to the pup joint 36. The slick joint 26 is received in a through-bore of the seal bushing 52. An outer sealing surface 28 of the slick joint 26 seals against and can slide within the through-bore of the seal bushing 52. For example, the outer sealing surface 28 can contact an internal seal 64 of the seal bushing 52. To avoid damaging the internal seal 64 (FIG. 4), the seal bushing 52 preferably includes wear rings 70 (FIG. 4). The seal bushing 52 includes an external seal 66 that seals against the inner wall of the pup joint 36. After expanding the expandable liner hanger 12, the seal bushing 52 can be disconnected from the pup joint 36 and retrieved with the expansion tool 22, leaving the liner assembly including the expandable liner hanger 12, the pup joint 36, and the liner 40, in the well.

As shown, a debris catcher 74 (FIG. 1) and the expansion cone 24 (FIGS. 1 and 2) are attached around the mandrel 78. The debris catcher 74 can be used to prevent debris from being caught between the expansion cone 24 and the inner wall of the middle section 16 and damaging the expansion cone 24 and/or the inner wall of the middle section 16 of the expandable liner hanger 12 during the expansion of the middle section 16.

Preferably, the expansion cone 24 is a solid cone that can form a seal against the inner wall of the expandable liner hanger 12 by metal-to-metal contact. However, other types of expansion cones can be used. Optionally, a cup seal can also be provided above and/or below the face of the expansion cone to form the seal against the inner wall of the expandable liner hanger 12. Drilling fluid can be pumped into the drill pipe 10 and can flow through the one or more lateral ports of the lateral port sub 32 when the expansion cone 24 moves up, and the volume sealed between the seal bushing 52 and the expansion cone 24 (or the seal cups, when provided) increases.

In use, at the levels of pressure typically encountered downhole, the gas present in the sealed volume when the system is assembled on the rig is compressed, and the volume sealed between the seal bushing 52 and the expansion cone 24 is already filled with substantially incompressible drilling fluid before the cement is pumped. After the cement is pumped into the drill pipe 10, a drill-pipe wiper dart is placed on top of the cement column in the drill pipe. The drill-pipe wiper dart and the cement column are pushed down the drill pipe 10 and the through-bore 76 of the expansion tool 22 by pumping drilling fluid on top of the drill-pipe wiper dart, usually until the drill-pipe wiper dart lands into and seals a dart receptacle 48 (FIG. 3) provided in a liner wiper dart 46 (FIG. 3) that is attached to the lower end of the expansion tool 22 by dart shear pins 50 (FIG. 3). However, both the cement and the drilling fluid pumped on top of the cement are substantially prevented from flowing through the one or more lateral ports provided in the lateral port sub 32 into the volume sealed between the seal bushing 52 and the expansion cone 24 because the overpressure utilized to push the cement column down the drill pipe 10 is not sufficient to move the expansion cone 24 upward, and the volume sealed between the seal bushing 52 and the expansion cone 24 does not increase to accommodate an inflow. Continued pumping of drilling fluid increases the pressure in the drilling fluid and the resulting downward force applied on the liner wiper dart 46 (FIG. 3). As a result, the dart shear pins 50 (FIG. 3) shear off, and the cement column is further pushed down the liner 40 by the combination of the liner wiper dart 46 and the drill-pipe wiper dart lodged into the dart receptacle 48. The column of cement exits the shoe 42 that is attached to the lower end of the liner 40 and is squeezed into the annulus between the liner 40 and the wall of the well, usually until the liner wiper dart 46 lands into and seals a shoe receptacle 44 provided in the shoe 42.

Referring primarily to FIG. 3, when the liner wiper dart 46 lands into and seals the shoe receptacle 44 provided in the shoe 42, continued pumping of drilling fluid increases the pressure in the liner 40, in the through-bore 76, in the volume sealed between the seal bushing 52 (FIG. 2) and the expansion cone 24 (FIG. 2), and in the drill pipe 10 (FIG. 1). No net force is applied to the seal bushing 52 (FIG. 2) because the pressure is balanced on either side of the seal bushing 52. The pressure that is applied to the bottom of the expansion cone 24 (or the seal cups, when provided) generates an upward force. The upward force moves the expansion cone 24 (FIG. 2) upwards, which results in the expansion of the middle section 16 (FIG. 1) of the expandable liner hanger 12 (FIG. 1).

The upward force is also transmitted to the middle section 16 of the expandable liner hanger 12 by the friction of the expansion cone 24 against the inner wall of middle section 16 of the expandable liner hanger 12. The upward force would tend to lift the liner 40 from the bottom of the well. The pressure is applied to the shoe 42 and the combination of the liner wiper dart 46 and the drill-pipe wiper dart lodged into the dart receptacle 48. The pressure generates a downward force that is transmitted to the liner 40. The downward force would tend to push the liner 40 toward the bottom of the well. However, the liner assembly is usually maintained in position because of drag forces between the liner assembly and the base casing and/or between the liner assembly and the wall of the well. In some cases where the drill pipe 10 (FIG. 1) is kept in place, the liner assembly may be pushed toward the bottom of the well where it stops.

In some cases, the liner wiper dart 46 may not seal after landing in the shoe receptacle 44 provided in the shoe 42, or the liner 40 may leaking pressure, and continued pumping of drilling fluid may not increase the pressure in the liner 40, the through-bore 76, and the volume sealed between the seal bushing 52 (FIG. 2) and the expansion cone 24 (FIG. 2). An operator may decide to drop a ball or another equivalent device. The ball is pumped through the drill pipe 10 and the through-bore 76 in the expansion tool 22, usually until it lands on and seals against the seat 34 provided in the through-bore 76 of the expansion tool 22.

Referring primarily to FIG. 4, continued pumping of drilling fluid increases the pressure in the through-bore 76, in the volume sealed between the seal bushing 52 and the expansion cone 24, and in the drill pipe 10, but not in the liner 40. The pressure that is applied to the bottom of the expansion cone 24 (or the seal cups, when provided) generates an upward force. The upward force moves the expansion cone 24 upward, which results in the expansion of the middle section 16 (FIG. 1) of the expandable liner hanger 12 (FIG. 1).

The upward force is also transmitted to the middle section 16 of the expandable liner hanger 12 by the friction of the expansion cone 24 against the inner wall of the middle section 16 of the expandable liner hanger 12. The upward force would tend to lift the liner 40 from the bottom of the well. The pressure is no longer balanced on either side of the seal bushing 52. The pressure that is applied to the top of the seal bushing 52 generates a downward force. The downward force is transmitted to the liner 40 via a pup joint shoulder 68 and optionally the plurality of dogs 56. The downward force would tend to push the liner 40 toward the bottom of the well. However, the liner 40 is maintained in position at or near the bottom of the well by the drag forces between the liner assembly and the base casing and/or between the liner assembly and the wall of the well. In some cases, an operator may rely on these drag forces and/or the weight of the liner assembly to maintain the liner 40 at the bottom of the well while pulling on the expansion cone 24 with the drill string 10 to assist further the upward movement of the expansion cone 24 and the resulting expansion of the middle section 16 (FIG. 1) of the expandable liner hanger 12 (FIG. 1).

Preferably, the cross-area between the outer sealing surface 28 of the slick joint 26 and the outermost diameter of the expansion cone 24 is essentially maximized so that the expansion pressure required to overcome the friction of the expansion cone 24 against the inner wall of middle section 16 of the expandable liner hanger 12 and move the expansion cone 24 is essentially minimized. Otherwise, the required expansion pressure could become so large that it would render the seal bushing 52 useless. The wall thickness of the expandable liner hanger 12 is determined in part such that the burst and collapse limits of the expanded liner hanger are comparable to the burst and collapse limits of the liner 40. The wall thickness of the expandable liner hanger 12 is also determined by the geometry of the liner 40 and requirements on the expanded diameter, such as to allow future tie-back operations with an upper completion or remediation if the expandable liner hanger 12 starts to leak or fails to seal. Once the wall thickness of the expandable liner hanger 12 is determined, the outermost diameter of the expansion cone 24 is determined such that the expansion of the expandable liner hanger 12 provides a quality clad to the base casing. The outer sealing surface 28 is determined by one or more of the following factors: a sufficient area of the through-bore 76 for implementing the seat 34 (FIG. 3) and allow the passage of a drill-pipe wiper dart, the rupture load when the drill-pipe wiper dart latches into the liner wiper dart 46 (FIG. 3) and shears off the dart shear pins 50 (FIG. 3), the burst and/or collapse loads during hydraulic expansion, and the pull load required to retrieve the seal bushing 52.

As shown, the seal bushing 52 includes a tubular body 54, the plurality of dogs 56, a sleeve 58 capable of sliding in the tubular body 54, the internal seal 64, the external seal 66, and the wear rings 70. Each of the plurality of dogs 56 is spring-loaded toward the center of the tubular body 54. However, in the configuration shown in FIG. 4, the plurality of dogs 56 are prevented from moving inward by the sleeve 58. The sleeve 58 is held in place with the bushing shear pins 62. Each of the plurality of dogs 56 is engaged with a shoulder of a groove 38 provided on the inner wall of the pup joint 36. As such, the seal bushing 52 is prevented from moving up. The seal bushing 52 is also prevented from moving down by the pup joint shoulder 68 and/or the groove 38.

The groove 38 is located along the pup joint 36 so that, when the expansion cone 24 is received through the end of the expandable liner hanger 12 connected to the pup joint 36 and the groove 38 is engaged by the plurality of dogs 56, the internal seal 64 of the seal bushing 52 is located outside of an interval between the expansion cone 24 and the one or more lateral ports provided in the lateral port sub 32. As such, the one or more lateral ports provided in the lateral port sub 32 are connected to the volume sealed between the seal bushing 52 and the expansion cone 24 (or the seal cups, when provided).

At the end of the expansion of the middle section 16 of the expandable liner hanger 12, an undercut 80 (FIG. 3) aligns with the internal seal 64. Therefore, the internal seal 64 no longer seals against the outer sealing surface 28, allowing the pressure to equalize across the seal bushing 52. Also, a slick joint shoulder 30 reaches the sleeve 58 and contacts its lower end. Under the effect of increased pressure applied to the bottom of the expansion cone 24 and/or the overpull exerted on the slick joint 26 of the expansion tool 22 by the drill pipe 10, the bushing shear pins 62 can shear off, and the slick joint shoulder 30 pushes the sleeve 58 upward. A recess 60 that is provided on the sleeve 58 of the seal bushing 52 aligns with the plurality of dogs 56, allowing the plurality of dogs 56 to move into the recess 60 and toward the center of the tubular body 54 and disengage from the groove 38 provided in the pup joint 36.

While a single row of dogs 56 and a single groove 38 are illustrated, any number of rows of dogs and corresponding grooves may be provided in other embodiments.

Additionally, the disclosure also contemplates at least the following embodiments:

Embodiment 1

Embodiment 1 is a system for setting a liner assembly in a well. Generally, the system comprises a seal bushing and an expansion tool. The seal bushing includes a tubular body and internal and external seals. The expansion tool includes a slick joint having an outer sealing surface that can slide within a through-bore of the seal bushing and an expansion cone attached to the slick joint. The slick joint is received in the through-bore of the seal bushing.

Preferably, the seal bushing is retrievable and includes a plurality of dogs biased toward a center of the tubular body, a sleeve capable of sliding in the tubular body.

Preferably, the expansion tool includes a through-bore, a seat provided in the through-bore of the expansion tool, and a lateral port connected to the through-bore of the expansion tool and located in an interval between the expansion cone and the seat.

Embodiment 2

Embodiment 2 is a system as described in embodiment 1 wherein the slick joint includes an undercut movable below the internal seal of the seal bushing.

Embodiment 3

Embodiment 3 is a system as described in embodiments 1 or 2, wherein the expansion cone is solid.

Embodiment 4

Embodiment 4 is a system as described in any of embodiments 1 to 3, wherein the sleeve of the seal bushing includes a recess capable of receiving at least a portion of each the plurality of dogs.

Embodiment 5

Embodiment 5 is a system as described in any of embodiments 1 to 4, wherein a shoulder is provided on the slick joint. The shoulder is capable of pushing the sleeve of the seal bushing when the slick joint slides within the through-bore of the seal bushing.

Embodiment 6

Embodiment 6 is a system as described in any of embodiments 1 to 5, generally further comprising an expandable liner hanger, the expandable liner hanger being shaped to receive the expansion cone through the end connected to the pup joint, and the expandable liner hanger having a constricted middle section expandable with the expansion cone.

Preferably, the system also further comprises a pup joint, the pup joint being connectable to a liner, and the expandable liner hanger having an end connected to the pup joint.

Optionally, the pup joint may include a groove, and the groove can be engaged by each of the plurality of dogs simultaneously. The groove is located along the pup joint so that the internal seal of the seal bushing can be located out of an interval between the expansion cone and the lateral port when the expansion cone is received through the end of the expandable liner hanger connected to the pup joint and the groove is engaged by each of the plurality of dogs.

Embodiment 7

Embodiment 7 is a method for setting a liner assembly in a well. Generally, the method comprises providing a system as described in any of embodiments 1 to 6. For example, the system can include an expansion system comprising a seal bushing and an expansion tool. The seal bushing includes an internal seal and an external seal. The expansion tool includes a slick joint having an outer sealing surface that can slide within a through-bore of the seal bushing and an expansion cone attached to the slick joint. The slick joint is received in the through-bore of the seal bushing. The method comprises positioning the expansion cone in an expandable liner hanger, expanding the expandable liner hanger in a well, and retrieving the expansion system from the well.

Preferably, the method comprises connecting a pup joint to the liner hanger, the pup joint having a groove. The method comprises connecting the pup joint to a liner. The seal bushing is retrievable and includes a tubular body, a plurality of dogs biased toward a center of the tubular body, a sleeve capable of sliding in the tubular body. The method comprises engaging each of the plurality of dogs in the groove.

Preferably, the expansion tool includes a through-bore, a seat provided in the through-bore of the expansion tool, and a lateral port connected to the through-bore of the expansion tool and located in an interval between the expansion cone and the seat.

Embodiment 8

Embodiment 8 is a method as described in embodiment 7, wherein the slick joint includes an undercut, and the method further comprises equalizing pressure across the seal bushing by aligning the internal seal with the undercut.

Embodiment 9

Embodiment 9 is a method as described in embodiments 7 or 8, wherein the expansion cone is a solid expansion cone, and the method further comprises sealing an interspace between the solid expansion cone and the liner hanger by metal-to-metal contact.

Embodiment 10

Embodiment 10 is a method as described in any of embodiments 7 to 9, wherein expanding the expandable liner hanger in the well is performed after landing a device on the seat provided in the through-bore of the expansion tool. Optionally, landing the device on the seat provided in the through-bore of the expansion tool is performed after attempting to increase pressure in the liner by pumping fluid.

Embodiment 11

Embodiment 11 is a method as described in any of embodiments 7 to 10, wherein expanding the expandable liner hanger in the well comprises increasing a pressure differential across the seal bushing during the expansion of the liner hanger. Optionally, expanding the expandable liner hanger in the well is performed at least in part by also pulling on the expansion cone with a drill string connected to the expansion tool.

Embodiment 12

Embodiment 12 is a method as described in any of embodiments 7 to 11, wherein retrieving the expansion system from the well comprises disengaging the plurality of dogs from the groove by aligning a recess provided on the sleeve of the seal bushing with the plurality of dogs. Optionally, the recess provided on the sleeve of the seal bushing is aligned with the plurality of dogs by pushing the sleeve of the seal bushing with a shoulder provided on the slick joint.

What is claimed is:

1. A method for setting a liner assembly in a well, the method comprising:

providing an expansion system comprising:

a seal bushing including a tubular body, an internal seal, and an external seal;

an expansion tool including a slick joint having an outer sealing surface that can slide within a through-bore of the seal bushing, and an expansion cone attached to the slick joint, wherein the expansion tool includes a through-bore, a seat provided in the through-bore of the expansion tool, and a lateral port connected to the through-bore of the expansion tool and located in an interval between the expansion cone and the seat; and wherein the slick joint is received in the through-bore of the seal bushing;

positioning the expansion cone in an expandable liner hanger;

connecting a pup joint to the liner hanger, the pup joint having a groove;

engaging each of a plurality of dogs in the groove;

connecting the pup joint to a liner;

expanding the expandable liner hanger in a well; and retrieving the expansion system from the well.

2. The method of claim 1, wherein the slick joint includes an undercut, the method further comprising equalizing pressure across the seal bushing by aligning the internal seal with the undercut.

3. The method of claim 1, wherein the expansion cone is a solid expansion cone, the method further comprising sealing an interspace between the solid expansion cone and the liner hanger by metal-to-metal contact.

4. The method of claim 1, wherein expanding the expandable liner hanger in the well is performed after landing a device on the seat provided in the through-bore of the expansion tool.

5. The method of claim 4, wherein landing the device on the seat provided in the through-bore of the expansion tool is performed after attempting to increase pressure in the liner by pumping fluid.

6. The method of claim 1, wherein expanding the expandable liner hanger in the well comprises increasing a pressure differential across the seal bushing during the expansion of the liner hanger.

7. The method of claim 6, wherein expanding the expandable liner hanger in the well is performed at least in part by pulling on the expansion cone with a drill string connected to the expansion tool.

8. The method of claim 1, wherein the seal bushing comprises a plurality of dogs biased toward a center of the tubular body and a sleeve capable of sliding in the tubular body, wherein retrieving the expansion system from the well comprises disengaging the plurality of dogs from the groove by aligning a recess provided on the sleeve of the seal bushing with the plurality of dogs.

9. The method of claim 8, wherein the recess provided on the sleeve of the seal bushing is aligned with the plurality of dogs by pushing the sleeve of the seal bushing with a shoulder provided on the slick joint.

10. A system for setting a liner assembly in a well, the system comprising:

a seal bushing including:

a tubular body, and internal and external seals; and an expansion tool including:

a slick joint having an outer sealing surface that can slide within a through-bore of the seal bushing, and an expansion cone attached to the slick joint, wherein the expansion tool includes a through-bore, a seat provided in the through-bore of the expansion tool, and a lateral port connected to the through-bore of the expansion tool and located in an interval between the expansion cone and the seat;

wherein the slick joint is received in the through-bore of the seal bushing.

11. The system of claim 10, wherein the slick joint includes an undercut movable below the internal seal of the seal bushing.

12. The system of claim 10, wherein the expansion cone is a solid expansion cone.

13. The system of claim 10, wherein the seal bushing includes:

a plurality of dogs biased toward a center of the tubular body; and a sleeve capable of sliding in the tubular body, wherein the sleeve includes a recess capable of receiving at least a portion of each the plurality of dogs.

14. The system of claim 10, wherein a shoulder is provided on the slick joint, wherein the shoulder is capable of pushing the sleeve of the seal bushing when the slick joint slides within the through-bore of the seal bushing.

15. The system of claim 10, further comprising:

a pup joint, the pup joint having a groove, the pup joint being connectable to a liner; and an expandable liner hanger having an end connected to the pup joint, the expandable liner hanger being shaped to receive the expansion cone through the end connected to the pup joint, the expandable liner hanger having a constricted middle section expandable with the expansion cone;

wherein the groove can be engaged by each of the plurality of dogs simultaneously; and wherein the groove is located along the pup joint so that the internal seal of the seal bushing can be located out of an interval between the expansion cone and the lateral port when the expansion cone is received through the end of the expandable liner hanger connected to the pup joint and the groove is engaged by each of the plurality of dogs.

* * * * *